United States Patent [19]

Zylbert

[11] 4,326,474

[45] Apr. 27, 1982

[54] IN-PLACE BOBBIN WINDING MECHANISM FOR A SEWING MACHINE

[75] Inventor: Thaddeus J. Zylbert, Morris Plains, N.J.

[73] Assignee: The Singer Company, Stamford, Conn.

[21] Appl. No.: 259,718

[22] Filed: May 1, 1981

[51] Int. Cl.[3] ..... D05B 57/14; D05B 59/00

[52] U.S. Cl. ..... 112/184; 112/279

[58] Field of Search ..... 112/184, 186, 279, 181

[56] References Cited

U.S. PATENT DOCUMENTS 3,115,855 12/1963 Ketterer ..... 112/184
3,138,127 6/1964 Ketterer ..... 112/184
3,154,035 10/1964 Edwards et al. ..... 112/184
3,693,566 9/1972 Ketterer ..... 112/184
4,259,914 4/1981 Johnson ..... 112/184

*Primary Examiner*—H. Hampton Hunter
*Attorney, Agent, or Firm*—William V. Ebs; Robert E. Smith; Edward L. Bell

[57] ABSTRACT

A bobbin resting on a bobbin case in the vertical axis looptaker of a sewing machine is provided with a slidable plunger which is biased into a position wherein the bobbin is disconnected from the looptaker and can rotate relative thereto. The plunger is depressable to a cam on the plate into a position wherein it is effective to cause the bobbin to be rotated with the looptaker for the winding of thread.

10 Claims, 13 Drawing Figures

IN-PLACE BOBBIN WINDING MECHANISM FOR A SEWING MACHINE

BACKGROUND OF THE INVENTION

1. Field of the Invention

The invention relates to bobbin winding mechanism and more particularly to mechanism for replenishing thread on a bobbin while in place in a looptaker.

2. Description of the Prior Art

Mechanisms for replenishing thread on a bobbin while in place in a looptaker and while stitch forming instrumentalities remain operatively associated as required for sewing are well known. Such bobbin replenishing mechanisms may be seen, for example, in U.S. Pat. No. 3,115,855 of S. J. Ketterer for "Bobbin Thread Replenishment Mechanisms in Sewing Machine Loop Taker" issued Dec. 31 1963, and in U.S. Pat. No. 3,693,566, also of S. J. Ketterer for "Bobbin Thread Replenishing Mechanisms for Sewing Machines" issued Sept. 26, 1972. It has been a disadvantage of bobbin thread replenishing mechanisms of the kind disclosed in said patents that they are complex and costly due to the inclusion of camming devices for raising and lowering a drive shaft into and out of driving engagement with the bobbin. A novel arrangement for overcoming such disadvantage including a bobbin axially movable on a resilient platform into and out of a driving relationship with a bobbin winding shaft is disclosed in the U.S. Pat. No. 4,259,914 of Ralph E. Johnson for "Bobbin Winding Mechanism for a Sewing Machine", issued Apr. 7, 1981. The present invention is directed to a further improvement in bobbin winding mechanisms, and has as its prime object the provision of a bobbin winding mechanism which in addition to being simple and inexpensive to construct doesn't require axial movement of a bobbin with a platform and so results during sewing operations in a substantially noiseless operation and prevents the snagging of thread under movable parts. The arrangement of the invention is readily adaptable to use with variously constructed sewing machines incorporating different bobbin case and looptaker arrangements.

SUMMARY OF THE INVENTION

In accordance with the invention, the bobbin of a lockstitch sewing machine having a vertical axis looptaker is provided with a slidable plunger which is biased into a raised position in the bobbin, but is depressable by a slide plate cam into a position wherein the bobbin is connected through the plunger to the looptaker for rotation therewith as required for bobbin winding. A thread guide enables the in-place threading of bobbin case thread tensioning means with needle thread in advance of the thread being picked up in a slot in the bobbin. Such thread guide is moveable out of a thread influencing position by slide plate camming means in preparation for the sewing of lockstitches with the plunger in its raised position and the bobbin freely rotatable.

DESCRIPTION OF THE INVENTION

Figure 1:
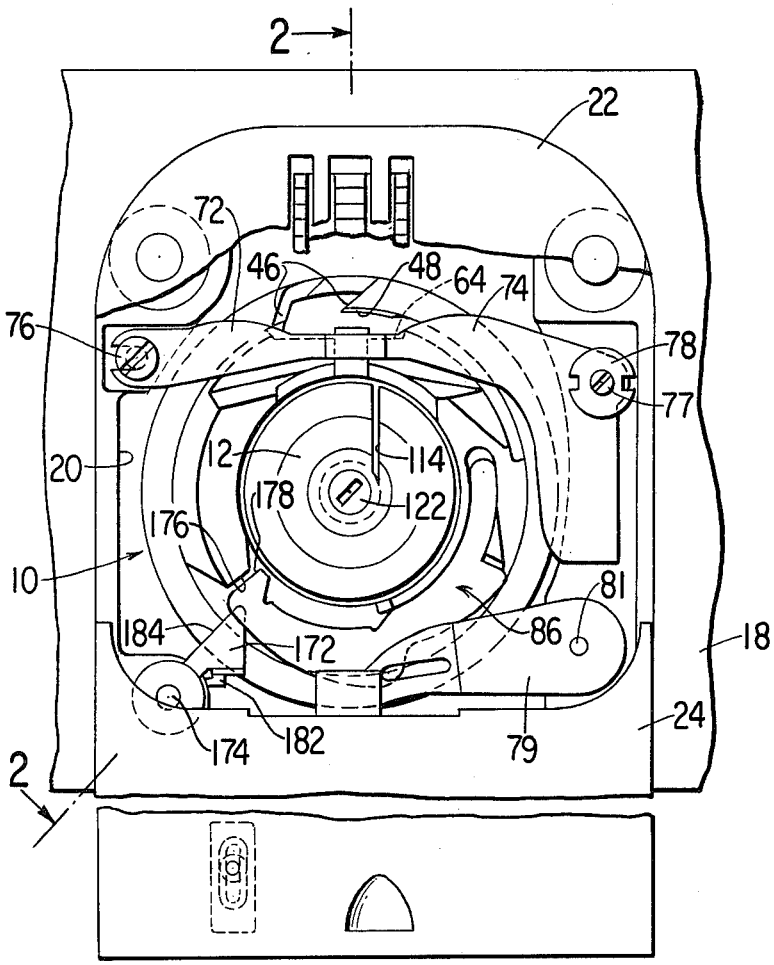
FIG. 1 is a top plan view of a portion of the bed of a sewing machine showing bobbin winding mechanism according to the invention as revealed with a slide cover plate for the looptaker of the machine in an open position.

Referring to the drawings, reference character 10 designates a looptaker suitable for use in various model sewing machines of which the machine shown in U.S. Pat. No. 2,862,468 issued Dec. 2, 1958 to R. E. Johnson is an example. Such patent is incorporated herein by reference and may be referred to for disclosure of all of the sewing machine mechanism save for the looptaker and mechanism disclosed herein for controlling the winding of thread on a bobbin 12.

As shown, looptaker 10 includes as an integral part thereof, a hollow shaft 14 which is journalled in a bushing 16. The bushing is carried in sewing machine bed 18 which is formed with an upwardly open looptaker accommodating cavity 20. A throat plate 22 partially covers the cavity and a slide plate 24 is movable over the remaining portion of the opening.

Turning movement is imparted in one direction during operation of the sewing machine to the looptaker 10 by a bevel gear 26 made fast on the looptaker shaft by a set screw 28 and in mesh with a bevel gear 30 on a driving bed shaft (not shown). Preferably, the looptaker makes two revolutions during each cycle of endwise reciprocation of a needle 36 which cooperates therewith in a formation of stitches passing through a needle hole 38 in the throat plate 22.

The looptaker 10 has an upwardly open cupshaped form including a rim 40 having an upwardly extending bearing shoulder 42. The rim is also formed with an annular inwardly extending bearing rib 44 having a lateral opening 46 formed at one side with a thread loop seizing beak 48. Needle 36 reciprocates in a path which traverses the plane containing the path of circular movement of the loop seizing beak 48. The looptaker includes a base 50 with an arcuate opening 52 to provide clearance for the tip of the needle. A thread pull-off member 54 supported on a step 55 is secured to the base 50 with a screw 56.

Constrained within the cupshaped looptaker is a bobbin case indicated generally at 58. The bobbin case is formed with an upwardly open bobbin accommodating cavity 59, and with an annular base 60 through which there extends a large central control aperture 61. Externally the bobbin case is formed with a bearing flange 62 which rests upon the bearing rib 44 of the looptaker and is constrained radially against the bearing shoulder 42. The bobbin case flange is slabbed at one side as at 64, substantially along a chord to provide clearance for the path of needle reciprocation between the bobbin case and looptaker. Adjacent to the slabbed portion 64 of the bobbin case flange, recesses 66 and 68 are provided in the bobbin case on either side of an abutment 70. Such recesses 66 and 68 receive the arms 72 and 74 of a bobbin case restraining member which is secured to the sewing machine bed 18 by screw 76, and by the screw 77 and nut 78. The arms 72 and 74 restrain upward movement of the bobbin case, and a connecting bridge 80 brackets abutment 70 to restrain rotation of the bobbin case. An arm 79 pivoted at 81 in the bed may be positioned as shown in FIG. 1 to assist in holding down the bobbin case, and may be moved off the bobbin case to permit its removal from the looptaker.

Figure 4:
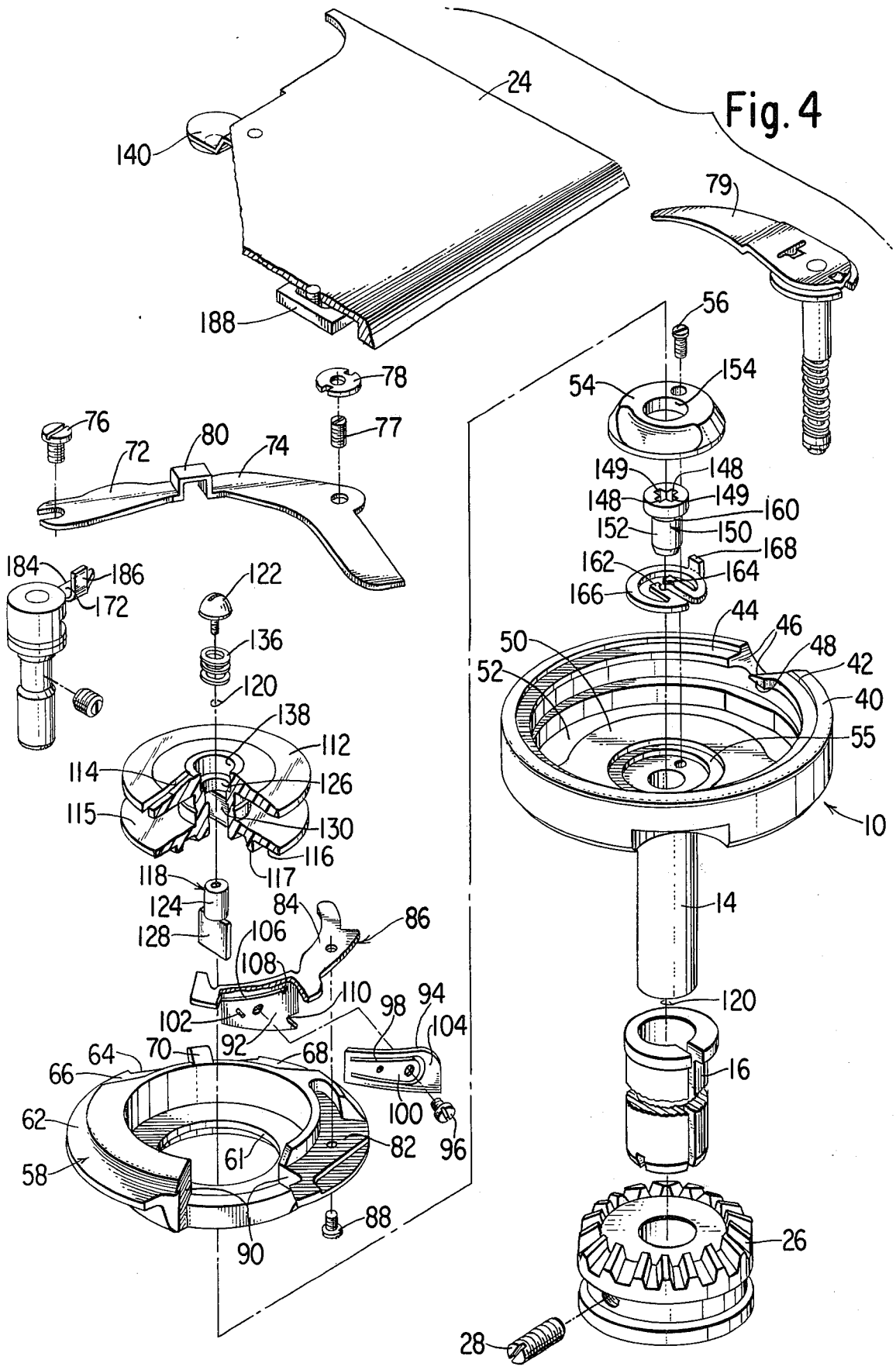
FIG. 4 is an exploded perspective view of the bobbin winding mechanism of the invention.
Figure 10:
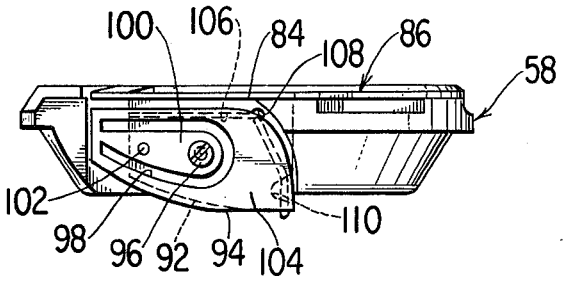
FIG. 10 is an elevational view of the bobbin case illustrating the bobbin thread tensioning spring means and showing the thread as it is located with respect to the spring means in the position of the parts as shown in FIG. 9.

The bobbin case flange 62 substantially diametrically opposite slabbed portion 64 is formed with a recess 82 on which a support arm 84 of a thread tensioning bracket 86 is secured by a fastening screw 88. The bobbin case adjacent to the recess 82 in the flange is formed with a radial opening 90 across which the thread tensioning spring bracket 86 spans. A downturned arm 92 on the bracket 86 is also disposed in the bobbin case radial opening 90 and provides a mounting surface against which a bobbin thread tensioning spring 94 is secured by a screw 96. As shown, spring 94 is formed with a slot 98 in the form of a U-shaped loop separating a tongue 100 through which the securing screw 96 and a locating pin 102 on the bracket 86 pass. Surrounding the tongue 100 is an outer spring blade portion 104 which frictionally engages the bobbin thread against the downturned bracket arm 92 to provide bobbin thread tension. The downturned arm 92 is formed with a thread entry slot 106 which is shown in FIGS. 4 and 10 terminates in an eyelet 108 for directing the thread to the spring blade portion 104 of tensioning spring 94. Below the spring, the downturned arm 92 is formed with a thread guiding groove 110 from which the bobbin thread leaves the spring and proceeds to a stitching point. The tension exerted on the thread by the spring blade portion 104 may be adjusted by regulating the fastening screw 96.

Bobbin 12 is rotatable within cavity 59 of the bobbin case 58. The bobbin includes a top flange 112 formed with an outwardly extending slot 114 skewed slightly from a true radial position on the top flange. The bobbin further includes a bottom flange 115 with a protruding annulus 116 which rests on annular base 60 of the bobbin case, and a depending boss 117 which extends into bobbin case aperture 61. A plunger 118 is mounted in the bobbin for slidable movement along the bobbin's axis of rotation 120. The plunger includes a top button-type screw in head 122, a cylindrical portion 124 slidable in a central bobbin aperture 126, and a key portion 128 slidable in a key accommodating slot 130 in the bobbin. A biasing spring 136 surrounding cylindrical portion 124 of the plunger under button type head 122, and located in a deep recess 130 in the bobbin, urges the plunger upwardly to a raised position defined by engagement of the upper ends of key 128 with the upper end of the bobbin slot 130 (see FIG. 2).

Figure 3:
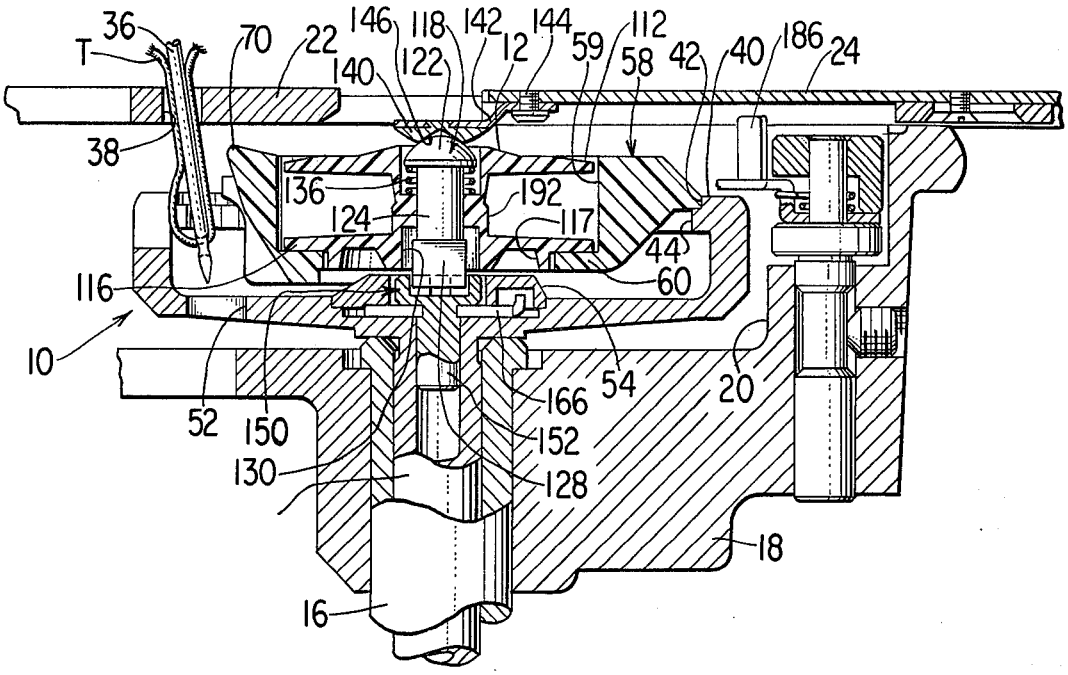
FIG. 3 is a view similar to FIG. 2 showing the slide plate in a partially open position as required for bobbin winding and showing a needle thread loop presented for seizure by the looptaker.
Figure 5:
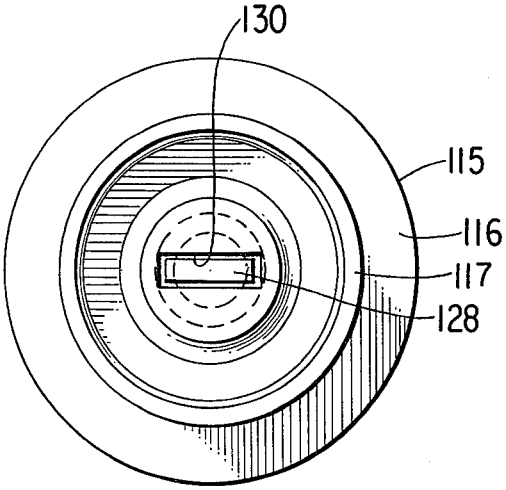
FIG. 5 is a bottom view of the bobbin.

A cam 140 is provided on the slide plate 24 to engage and urge the plunger 118 downwardly in the bobbin 12 against the biasing spring 136 when the slide plate is in a partially open position. As shown, the cam 140 is attached by way of a flexible arm 142 to the underside of the plate at 144 and includes a recessed surface 146. Recessed surface 146 and the surface of button-type head 122 include complementary contacting portions which serve to hold the plate stationary while the cam is directly over head 122. The downward urging of plunger 118 by cam 140 in the partially open position of plate 24 causes a bottom end portion of the key 128 on the plunger, during operation of the machine, to enter a key accommodating crossed slot 148 or 149 in the upper end of a chuck 150 when the slot is rotationally aligned to receive the key (see FIG. 3). The plunger is thereby coupled to the chuck to provide for rotation of the bobbin 12 with the looptaker 10, and the winding of thread on the bobbin.

As shown, chuck 150 includes a stub shaft 152 which is mounted for rotation in hollow looptaker shaft 14 about the axis 120, such axis being common to both the plunger 118 and shaft 14. The upper end of chuck 150 including key accommodating slots 148 and 149 is located in an opening 154 in bobbin thread pull-off member 54 which as already noted, is secured to looptaker 10 with screw 56. Such pull-off member serves a well understood function in pulling off and positioning bobbin thread during a sewing cycle as described for example for bobbin thread pull-off structure in U.S. Pat. No. 3,693,565 of Sept. 26, 1972. The chuck 150 is frictionally engaged in an annulus 160 by the end portions 162 and 164 of a spring clutch 166 having a tang 168 thereon which extends into a slot 170 in the pull-off member to establish a driving connection between the pull-off member and chuck through the clutch.

A thread guiding finger 172 is pivotally mounted in bed 18 on a pin 174 located approximately opposite a thread accommodating passageway between one edge 176 of the bobbin case opening 90 and one extremity 178 of the bracket 86 which supports the bobbin thread tensioning spring 94. The thread guiding finger 172 is biased by a torsion spring 180 toward a position of engagement with a stop 182, and is caused by the spring to assume such position whenever the slide plate 24 is in any position except a fully closed position. In the stop engaged position of finger 172, one edge 184 thereof is disposed to engage and guide needle thread T into the thread accommodating passageway in the bobbin between edge 176 and extremity 180 of the opening 90 and bracket 86 respectively as the thread is moved around bobbin case 58 by looptaker 10. As shown, finger 172 includes an upstanding tang 186. The tang 186 is engaged by a slidably adjustable cam 188 on the underside of slide plate 24 when the slide plate is moved to its fully closed position and the finger 172 is then moved to and held by the cam 188 in a position wherein edge 184 no longer directs thread to the thread accommodating passageway in the bobbin.

When it is desired to replenish thread on the bobbin 12, an operator detains the free end of thread extending from the eye of needle 36 above the throat plate 22, and moves slide plate 24 into its partially closed position wherein cam 140 is caused to engage head 122 of plunger 118. The operator then initiates operation of the machine to cause reciprocation of the needle 36 and rotation of the looptaker 10. The plunger 118 which is coupled to chuck 150 by the downward urging of cam 140, as described hereinbefore, is rotated by the looptaker attached pull-off member 54 acting through spring clutch 166 and the chuck 150. Bobbin 12 is rotated by the plunger acting through key 128.

Figure 6:
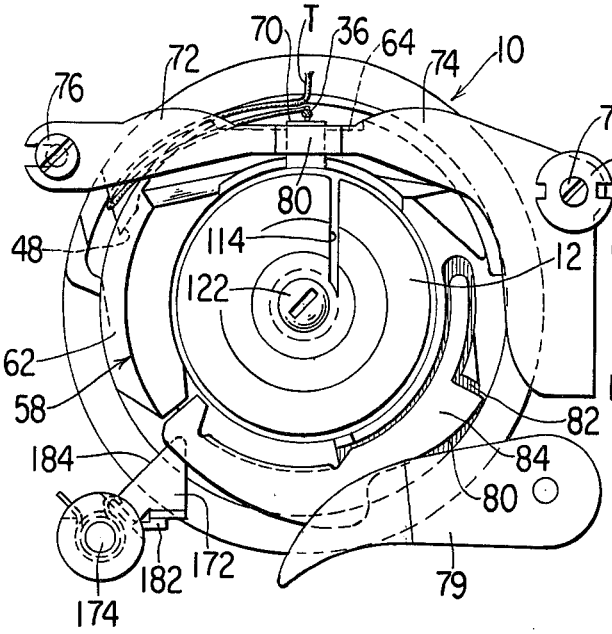
FIG. 6 is a top plan view of the looptaker with mechanism for replenishing bobbin thread shown in operative condition for bobbin winding and with the looptaker beak in a position immediately after seizure of a thread loop from a needle.
Figure 7:
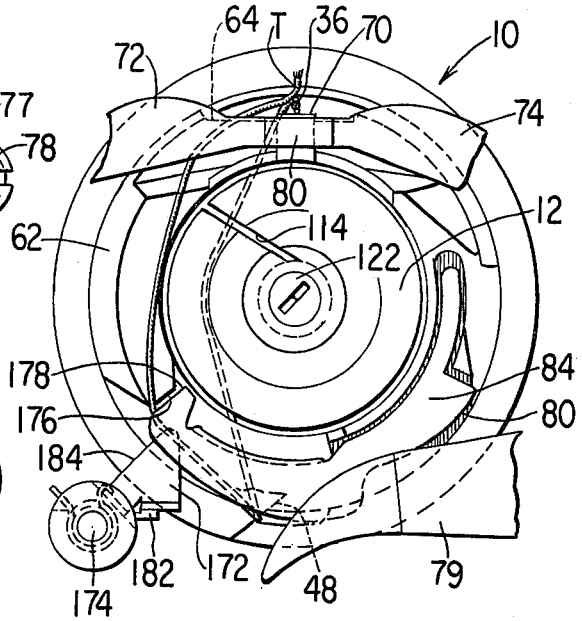
FIG. 7 is a top plan view similar to FIG. 6 but showing the hook in a position in which the thread loop seized thereby is being guided into bobbin thread tensioning means.
Figure 11:
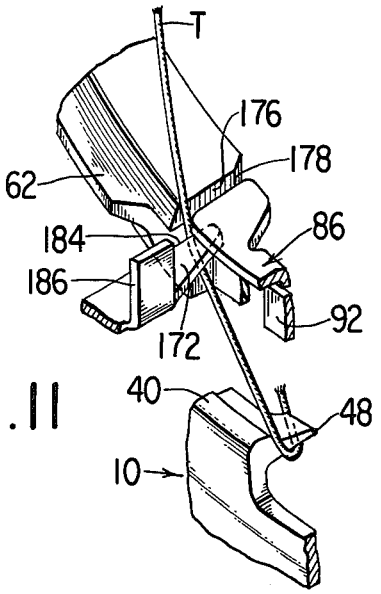
FIG. 11 is a perspective view showing a fragment of the bobbin case, thread tensioning means, thread guiding finger and hook beak, and showing thread being directed to the thread tensioning means while the slide plate cover is in a partially closed position.
Figure 12:
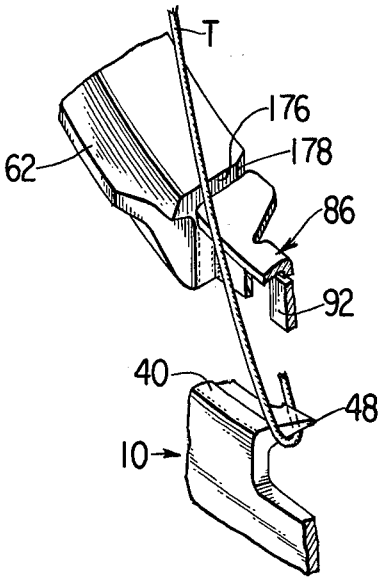
FIG. 12 is a view similar to FIG. 11 showing a needle thread loop by passing the bobbin thread tensioning spring as during sewing.

On the first dip of the needle, both limbs of the needle thread through the eye of the needle depend downwardly through the needle aperture in the throat plate, and the looptaker beak 48 seizes the needle thread loop as illustrated in FIG. 6. As rotation of the looptaker continues, the seized needle thread loop separates into an upper loop extending over the bobbin case and a lower loop extending thereunder. The upper loop, which is the free end of the needle thread loop from the needle eye detained above the throat plate, is caused to encounter edge 184 of finger 172 as shown in FIGS. 7 and 11, and is guided thereby into the bobbin thread accommodating passageway from which it moves into thread entry slot 106 and eyelet 108. The needle thread will at this stage have been introduced between the downturned arm 92 of the bracket 86 and the blade 104 of the thread tensioning spring but the thread will not as yet have been introduced into the bobbin, nor will the thread have been cast loose from the looptaker beak and drawn into the thread guiding groove 110.

Figure 8:
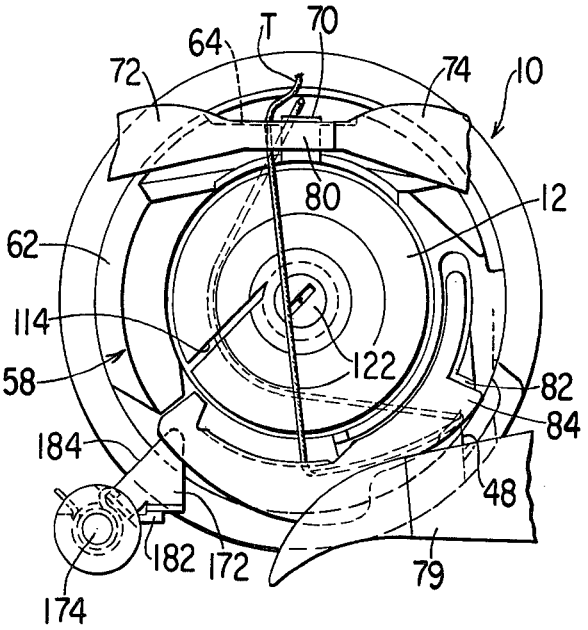
FIG. 8 is a top plan view similar to FIG. 6 but showing a position of parts in which the thread loop is about to be shed from the looptaker beak.
Figure 9:
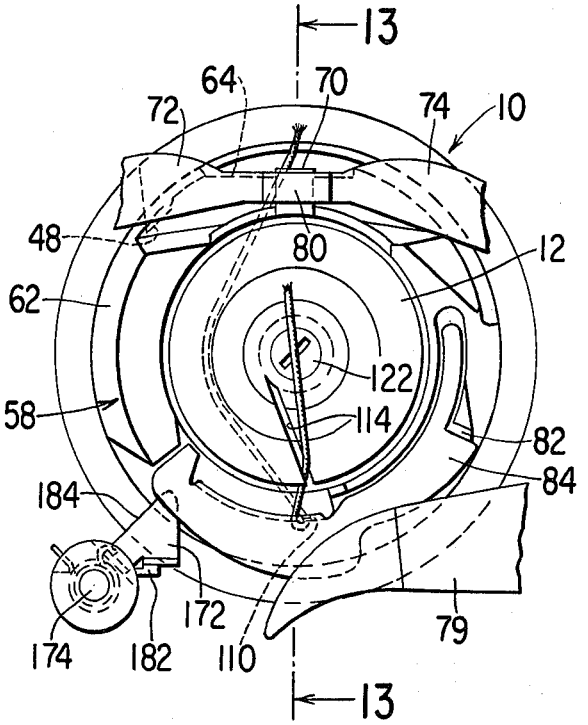
FIG. 9 is a top plan view similar to FIG. 6 but showing a position in which the thread loop is entering a bobbin flange slot.
Figure 13:
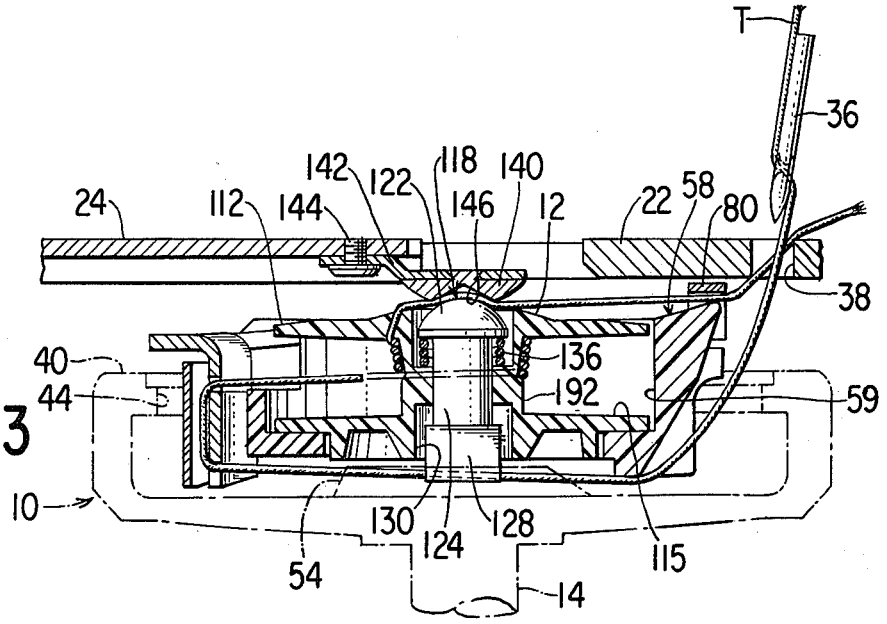
FIG. 13 is a cross-sectional view through the rotary hook taken substantially along the line 13—13 of FIG. 9 but showing the position of the thread after several rotations of the bobbin during thread replenishment and indicating the manner in which an end of the thread is severed.

As rotation of the looptaker beak continues beyond the position shown in FIG. 8, the needle thread loop is drawn off the looptaker beak 48. Rotation of the bobbin results in bobbin slot 114 being moved under the upper limb of the needle thread loop. Such upper limb enters the bobbin through slot 114 and is wrapped around the hub 192 of the bobbin. As wrapping of the thread continues slack is dissipated in the thread and it is drawn into the groove 110 (see FIG. 9). Slot 114 is skewed with respect to a radius of the bobbin to result in the upper limb of thread being moved across the cam 140 and the thread being severed at the cam by abrading action of the thread thereon due to rotation of the bobbin (FIG. 13). Thereafter, continued rotation of the bobbin serves to wind thereon replenishment thread for later use as bobbin thread in the formation of lockstitches.

Figure 2:
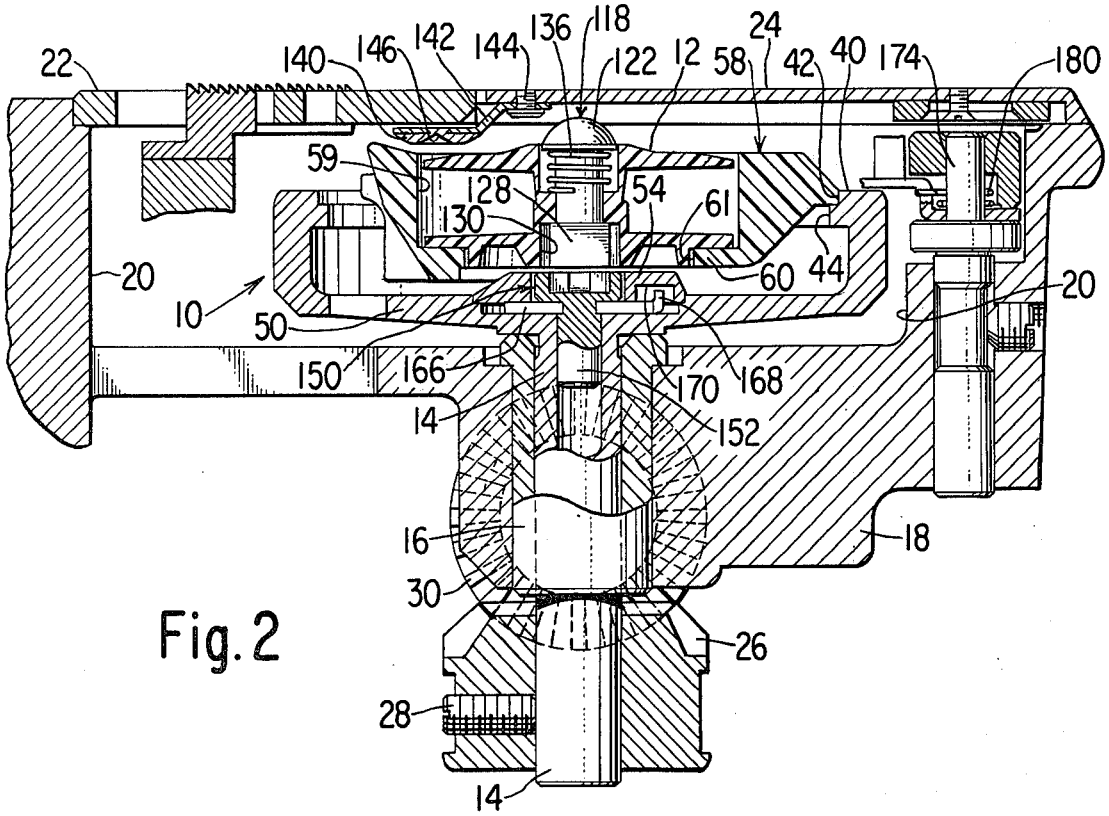
FIG. 2 is a fragmentary vertical sectional view taken through the bed substantially on the plane of the line 2—2 of FIG. 1, and showing the slide plate in a fully closed position.

After the bobbin has been replenished with thread, the slide plate 24 is moved to a fully closed position (FIG. 2). The cam 140 is thereby moved off the head of plunger 118 and the plunger is raised by spring 136 to disengage the plunger from chuck 150, and so discontinue rotation of the bobbin by the looptaker. Movement of the slide plate 24 into the fully closed position brings cam 188 into engagement with tang 186 on finger 172 and causes the finger to be moved away from the looptaker into a position permitting thread to pass over the thread accommodating passageway in the bobbin case leading to the thread tensioning means (see FIG. 13). With the slide plate fully closed, lockstitches may be formed in a manner well understood in the art.

A particular embodiment of the invention has been shown and described by way of illustration. However, many modifications will occur to those skilled in the art, and it is to be understood that it is intended to cover all changes and modifications falling within the true spirit and scope of the invention as set forth in the annexed claims.

I claim:

1. In a sewing machine, the combination comprising a reciprocable needle, a rotatable vertical axis needle looptaker, a bobbin case nested in the looptaker, means preventing the bobbin case from rotating, a bobbin disposed within and resting on the bobbin case, a plunger which is mounted in the bobbin for endwise sliding movement along the axis of the bobbin and upon which the bobbin is rotationally restrained, means biasing the plunger into a raised position in the bobbin, a slidable plate with a cam thereon for engaging and moving the plunger from said raised position to a depressed position in the plunger, means for operably connecting the plunger to the looptaker in the depressed position in the plunger to provide for rotation of the bobbin with the looptaker, and for disconnecting the plunger from the looptaker upon movement of the plunger to the raised position to thereby enable the bobbin to rotate free of the looptaker.

2. The combination of claim 1 wherein said cam and plunger include complementary engaging surface portions which serve to hold the plate stationary while the plunger is depressed by the cam.

3. The combination of claim 1 wherein the connecting and disconnecting means includes a slip clutch.

4. The combination of claim 1 wherein the connecting and disconnecting means includes a chuck engageable with and disengageable from the plunger, and said connecting and disconnecting means further includes a slip clutch.

5. The combination of claim 4 wherein the slip clutch is a spring drivable by the looptaker and in frictional engagement with the chuck.

6. The combination of claim 5 wherein the looptaker is provided with a bobbin thread pull-off member and the spring includes a tang which engages the thread pull-off member to establish the driving connection between the chuck and looptaker through said spring.

7. The combination of claim 1 including thread tensioning means on the bobbin, and means for moving needle thread into the bobbin thread tensioning means when the slidable plate is moved to depress the plunger.

8. The combination of claim 7 wherein the thread moving means includes a thread positioning finger mounted in the machine for movement relative to the bobbin case, and spring means for urging the finger into a thread positioning location.

9. The combination of claim 8 including a camming means on the slidable plate for moving the thread positioning finger away from the thread positioning location when the slide plate cam is moved away from the plunger.

10. The combination of claim 9 wherein said camming means is adjustable.

* * * * *